US005752549A

United States Patent [19]

Derudder et al.

[11] Patent Number: 5,752,549

[45] Date of Patent: May 19, 1998

[54] WORK THREAD-TENSIONING AND PULL-BACK DEVICE FOR JACQUARD PILE WEAVING MACHINE CREEL

[75] Inventors: Carlos Derudder, Heule; Erik Vermeulen, Kortrijk, both of Belgium

[73] Assignee: N. V. Michel Van de Wiele, Marke, Belgium

[21] Appl. No.: 644,154

[22] Filed: May 10, 1996

[30] Foreign Application Priority Data

May 11, 1995 [BE] Belgium ..... 09500426
Mar. 13, 1996 [BE] Belgium ..... 09600219

[51] Int. Cl.[6] ..... D02H 1/00; D02H 13/24; B65H 59/36; B65H 59/02

[52] U.S. Cl. ..... 139/97; 28/187; 242/131.1

[58] Field of Search ..... 139/97, 102, 103, 139/21, 450; 242/128, 130, 131, 416, 417, 566, 593, 131.1; 28/187

[56] References Cited

U.S. PATENT DOCUMENTS

| | | | |
|---|---|---|---|
| 2,323,282 | 6/1943 | Kaufmann | 28/187 |
| 2,447,553 | 8/1948 | Barnes et al. | 28/187 |
| 2,885,158 | 5/1959 | Koppelman . | |
| 3,520,493 | 7/1970 | Carroll | 242/131.1 |
| 4,164,963 | 8/1979 | Black | 139/103 |
| 4,792,101 | 12/1988 | Van Bogaert et al. . | |
| 5,372,164 | 12/1994 | Cloer | 242/131.1 |

FOREIGN PATENT DOCUMENTS

| | | |
|---|---|---|
| 905810 | 11/1986 | Belgium . |
| 1196127 | 11/1959 | France . |
| 6401645 | 8/1965 | Netherlands . |
| 1162216 | 8/1969 | United Kingdom . |

*Primary Examiner*—Andy Falik
*Attorney, Agent, or Firm*—Sughrue, Mion, Zinn, Macpeak & Seas, PLLC

[57] ABSTRACT

A thread-tensioning and pull-back device for use with a weaving machine for controlling the tension of a series of warp threads pulled off from removable and replaceable bobbins arranged in rows in a weaving rack of a weaving machine is adapted to be located in front of the weaving rack of the weaving machine. The device includes a series of thread guide plates each having a feed-through eye whereby each guide plate tensions the thread through each guide plates own weight. The guide plates could also be leaf springs which tension the threads by bending stress.

11 Claims, 6 Drawing Sheets

WORK THREAD-TENSIONING AND PULL-BACK DEVICE FOR JACQUARD PILE WEAVING MACHINE CREEL

BACKGROUND OF THE INVENTION

1. Field of the Invention

The present invention relates to a thread-tensioning and pull-back device and also a braking device for a weaving machine.

It is used in particular in jacquard weaving machines which use different yarns for each individual warp thread.

2. Description of the Prior Act

Belgian Patent No. 905,810 discloses a method for drawing thread from a bobbin in weaving machines and a device used in the process. Each thread is guided by a thread guide placed behind the bobbin, in such a way that the distance between the thread guide and the bobbin is regulated automatically essentially during the weaving process.

Other tensioning devices are described in the literature. They consist of one or more clamps or shackles which in each case are suspended from the pulled-down thread loop one in front of and one behind the bobbin.

U.S. Pat. No. 2,885,158 describes a warp thread-tensioning and pull-back device for a weaving rack, consisting of one or more clamps or shackles which are a certain weight and in each case are also suspended from the pulled-down thread loop one in front of and one behind the bobbin. The pulled-down warp thread is first passed backwards over the rear reversing guide spindle and is then taken forwards over the front guide spindle. A first clamp or shackle is suspended over the warp thread loop between the bobbin and the rear guide spindle, and a second clamp or shackle is suspended between the bobbin and the front guide spindle. The two clamps with the thread form a sort of band brake on the cylindrical surface of the bobbin. When a warp thread is now drawn through the weaving process for use in the weaving zone, the warp thread tightens until the two clamps are lifted, so that the thread loop also leaves the bobbin body and the brake is released. The bobbin unwinds until the thread loop pulls back on the bobbin through the weights, and the braking again becomes effective. Through the unwinding of the thread, the clamps in fact fall again on the bobbin and again produce braking thereon. During the falling movement of the front clamp or shackle, the warp thread is also pulled back out of the weaving zone, so that there is sufficient compensation here for the various positions of the warp thread in the shed.

The tension on the warp thread is determined by the weight of the clamps and the number of friction points of guided spindles and grates present. This tensioning device is simple to make and is fairly cheap, but it has a number of disadvantages.

A first disadvantage is that a clamp placed in the furthest back part of the rack is less efficient than a clamp placed in the front part of the rack. First, due to the greater number of friction points over the guide spindles and the intermediate grates, the warp thread is pulled back less efficiently and, secondly, the resistance to pulling through warp threads is greater: the pile will tend to become shorter for these warp threads.

A second disadvantage of the known device is the difficulty of replacing a bobbin. The bobbin fitter first has to suspend both clamps or shackles from the adjacent guide spindle. He then has to remove an old bobbin and place a new bobbin, and lastly has to cut off the warp thread from the old bobbin and join it to the start of the new bobbin. He also has to turn this bobbin until the warp thread has come to tension, and then again pull the clamps of the guide spindles in front of and behind the bobbin onto the warp thread.

Since the location of these shackles vertically and in the breadthwise direction cannot be established accurately, it is not possible to replace a bobbin mechanically. In order to adapt the tension in the warp thread, it is necessary to place shackles of a different weight. Several shackles can also be placed. Of course, it takes a long time to provide all of the large number of bobbins in the weaving rack with such a number of weights.

A third disadvantage is that one has to have available a series of clamps or shackles of different weights, in order to be able to change the warp tension for adaptation to various types of yarns.

SUMMARY OF THE INVENTION

The object of the present invention is to eliminate these disadvantages. To this end, the invention proposes a warp thread-tensioning and pull-back device for a weaving rack of the type described in the introductory part of the appended claim 1. According to the invention, an empty bobbin is easily replaced if the warp thread-tensioning and pull-back device is made independent of the bobbin and is disposed at the front, separately from the weaving rack.

In a first embodiment, it consists of plates with feed-through eye, which are disposed slidably in a holder.

A tensioning device is fitted at the front in each rack door and between two grates, and each warp thread bobbin is braked by a continuous band brake per row or part of a row.

The operation of such a thread-tensioning and pull-back device for a weaving machine is smoother, because each warp thread bobbin is braked by a continuous band brake per row or part of a row, and the bobbins which have been placed on the front part of the rack are braked as desired more or less than the back bobbin. This means that the front bobbins, which are placed on the front part of the rack, can be braked more than the back bobbins, which are thus braked less, and also vice versa.

The thread guide plates slide through grooves which cause a certain resistance through friction. In order to be able to take a high density of warp threads, the device must be constructed with a part upwards and a part downwards. This arrangement not only takes a fairly large amount of space in height, with the result that the length of the pull-back springs has to be kept short, but the setting below and above also has to be different, since the weight in the bottom part assists and that in the top part opposes.

The tensioning device is situated at virtually the same distance from the weaving zone or inlet grate. Replacing a bobbin is less time-consuming through the fact that there is no longer any handling of weights. Adjustment to the type of thread can take place by acting upon spring tension.

A new braking device is also proposed on each bobbin, achieved in the following way. The bearing spindle of each bobbin is equipped with a plastic sleeve which is fitted rotatably.

Said rotating sleeve is provided at one side with a projection with V-groove, or a grooved wheel made of plastic is glued to the rotating sleeve. The rotating sleeve is pushed with the V-groove side first onto the bearing spindle and rotatably fixed. A cord or line per row or part of a row is stretched over the V-groove discs and is clamped at one side by tensioning device or spring. Said cord or line acts as a holding brake on each sleeve, so that the creeled bobbin holds the pulled-off thread at tension between the reversing guide spindle and the tensioning device. The advantage of this is that the bobbin is easy to remove and replace with a new one. The braking device with rotating sleeve remains on the bearing spindle of the rack, and the bobbin is pushed with its own cardboard sleeve onto the rotating sleeve, so that the weights no longer have to be removed or put in position. This means a considerable time gain when replacing the bobbins in the rack. The braking force on the bobbins can be set by tensioning the cord or line to a greater or lesser extent. Clamps with a different weight are thus no longer necessary. The rack can be divided into compartments with, for example, more braking at the front than at the back, or vice versa, according to what is needed for good operation.

In a second embodiment, one of the plates consists of a leaf spring which is clamped at one side.

According to a special feature of the invention, the leaf spring is bent over at a free end and provided with a feed-through eye. In this case each leaf spring tensions the thread by bending stress.

In a special embodiment, each leaf spring is given an adjustable initial tension. To this end, the leaf spring is clamped in an adjustable holder. The holder for clamping can be fixed in various angular displacements, in order to ensure a certain adjustable warp thread tension.

In a preferred embodiment, a warp guide bar is provided between the warp thread brake and the leaf springs.

A sensor or electrode detects, and converts into a signal, the presence of an extreme deviation in the bend of the leaf spring due to excessive tension of the warp thread when there is a fault in the unreeling from the bobbin, in which case the feed-through eye of the leaf spring goes into line with the thread.

On the other hand, a deflection of the leaf spring in its most relaxed position when there is a thread breakage is also detected and converted into a signal. The weaving machine may be brought to a standstill if necessary.

It is advantageous to fit the leaf spring and the sensor on one and the same adjustable holder.

The invention also relates to an independent module, in which thread guide combs, leaf springs and warp thread brakes are assembled, and which is intended for installation at the front and separately from a weaving rack.

These and other characteristics and special features of the thread-tensioning device according to the invention emerge from the description which follows and in which reference is made to the drawings appended hereto.

BRIEF DESCRIPTION OF THE DRAWINGS

These drawings are as follows.

In these figures the same reference numbers refer to identical or similar elements.

DESCRIPTION OF THE PREFERRED EMBODIMENT

Figure 1:
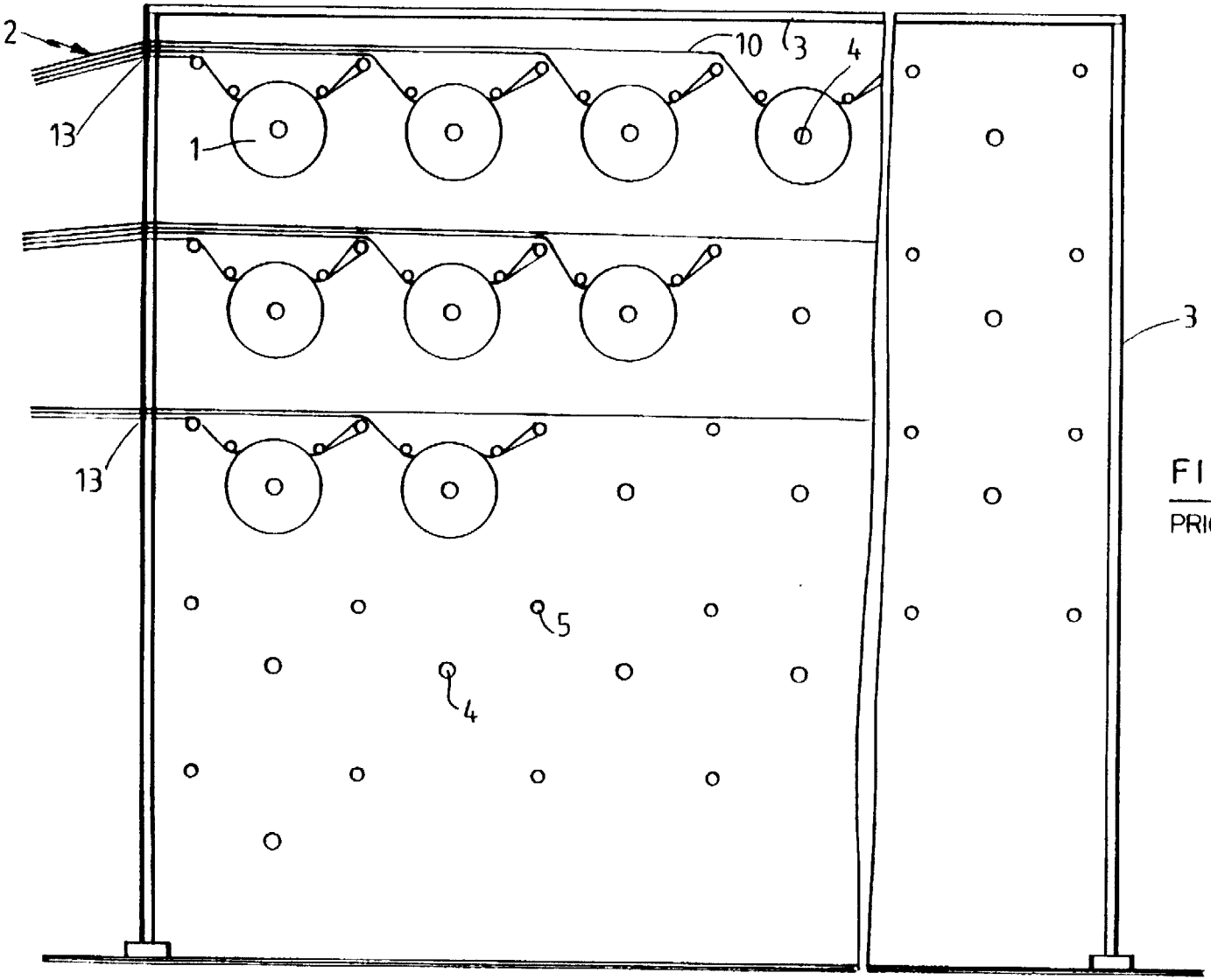
FIG. 1 PRIOR ART
FIG. 1: a side view of a bobbin rack with tensioning device belonging to the prior art.

In the case of jacquard weaving machines where a different yarn is used for each individual warp thread 10 the figuring or pile warp threads are fed from the individual bobbins 1 to the weaving zone 2. These bobbins 1 are placed in a creel rack 3 behind the weaving machine. Such a rack 3 may consist of a number of doors which have a number of bearings and guide spindles on both sides. The doors are disposed adjacent to each other. We distinguish between rotatable doors: the rack 3 has at the front a fixed axis of rotation at a mutual fixed distance, and the door frame can pivot about this vertical axis, in order to provide better access to the bobbins 1 in the direction from back to front. Other racks are immovably fixed: between two doors sufficient space is then left to provide access to the bobbins for replacement or replenishment.

A number of spindles are disposed heightwise, and a number depthwise. A limited number of doors can be placed next to each other in the breadthwise direction or weft insertion direction of the weaving machine. The number of bobbins 1 heightwise is limited to a multiple of the number of cord or color systems in which the weaving is being carried out. This number can also be divided over the ground floor and one upper floor. This is the case in particular when the aim is to work with a large yarn stock per bobbin. In order to achieve the total required number of bobbins 1, the rack 3 is then extended mainly depthwise. Each bobbin 1 is pushed onto a bearing spindle with the aid of a rotating sleeve 6. The bobbin can even be rotatable on the spindle by way of this rotating sleeve 6, but the sleeve can also be pushed onto a second rotating sleeve 6 which always remains rotatably connected to the bearing spindle of the rack 3. The yarn end from the bobbin 1 is first passed over a rear guide spindle 5 and then brought forward again over the front guide spindle. The yarn end is then brought forward in the rack 3, passing over the number of front guide spindles through any intermediate grates present, to the guide grate 13, which has to separate the large number of threads from each other. From this guide grate 13, the yarn is funnelled to an inlet grate, which is not shown. From said inlet grate the warp thread 10 is fed in layers through any warp stop motions which may be present, and is fed from there to the weaving zone 2, where the warp thread 10 is ultimately woven to form a fabric.

Figure 2:
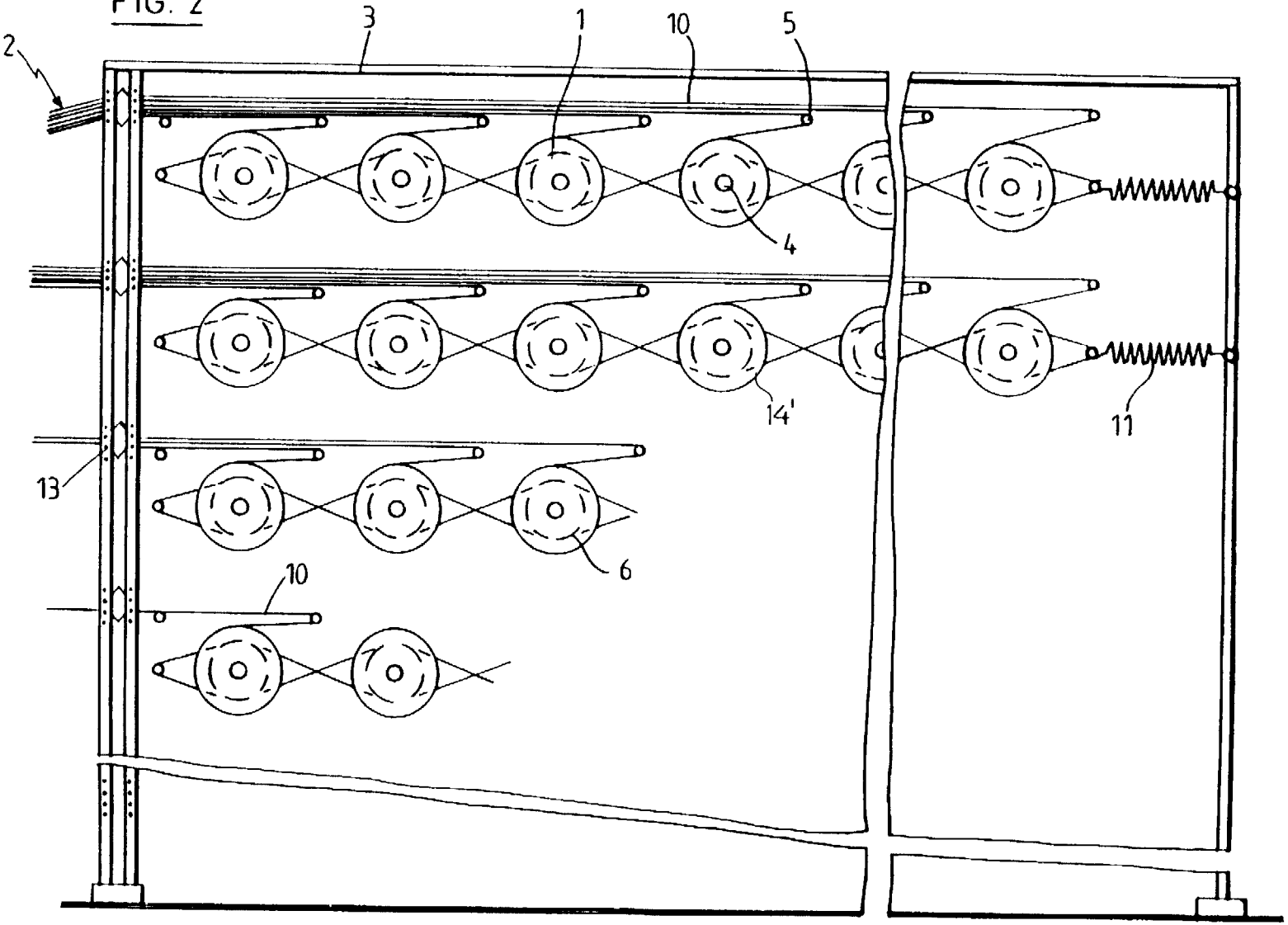
FIG. 2: a side view corresponding to that of FIG. 1 of a first embodiment of the tensioning device according to the invention.

For the formation of the weaving shed, each individual warp thread for successive weft insertions is taken to different positions by the jacquard heald, which is moved by means of a harness cord through the jacquard device. In order to hold the warp thread 10 under tension in a particular position during the movement and in the stationary position, a tensioning device is provided on each bobbin 1 in the rack 3. In the case of face-to-face weaving machines, in particular for pile fabrics, either two or three positions are needed, depending on whether the single-spool or double-spool weaving method is used. In each of these positions the pile warp thread must be held under tension, and also during the movement for shed change, on the one hand in order to prevent the pile threads from falling slack and becoming entangled with each other but, on the other hand, also in order to pull an accurate pile loop with uniform pile height, and in order to prevent slack loops on the back of the carpet and slack loops between pile rows of tying-in pile warp threads 10. In other words, the problem to be solved is to weave the pile material as tightly as possible, in order to limit excessive pile material consumption, and in order to ensure a uniform pile surface. For this purpose, pile thread must even be pulled back out of the weaving zone to the rack 3, and at as uniform a tension as possible for all bobbins 1 (FIG. 2).

Figure 3:
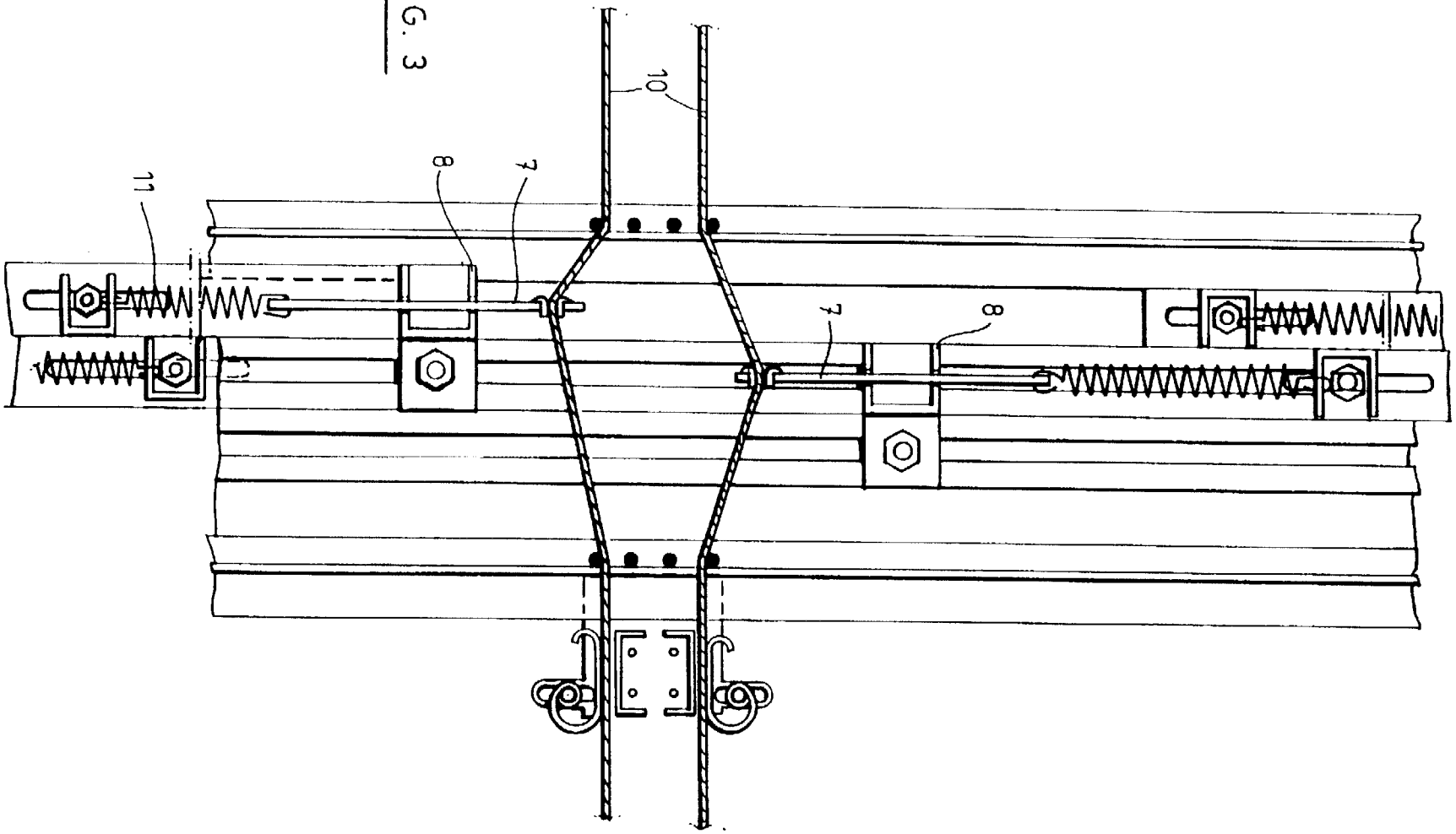
FIG. 3: a side view on a larger scale of the fastening of the spring tension shown in FIG. 2.
Figure 4:
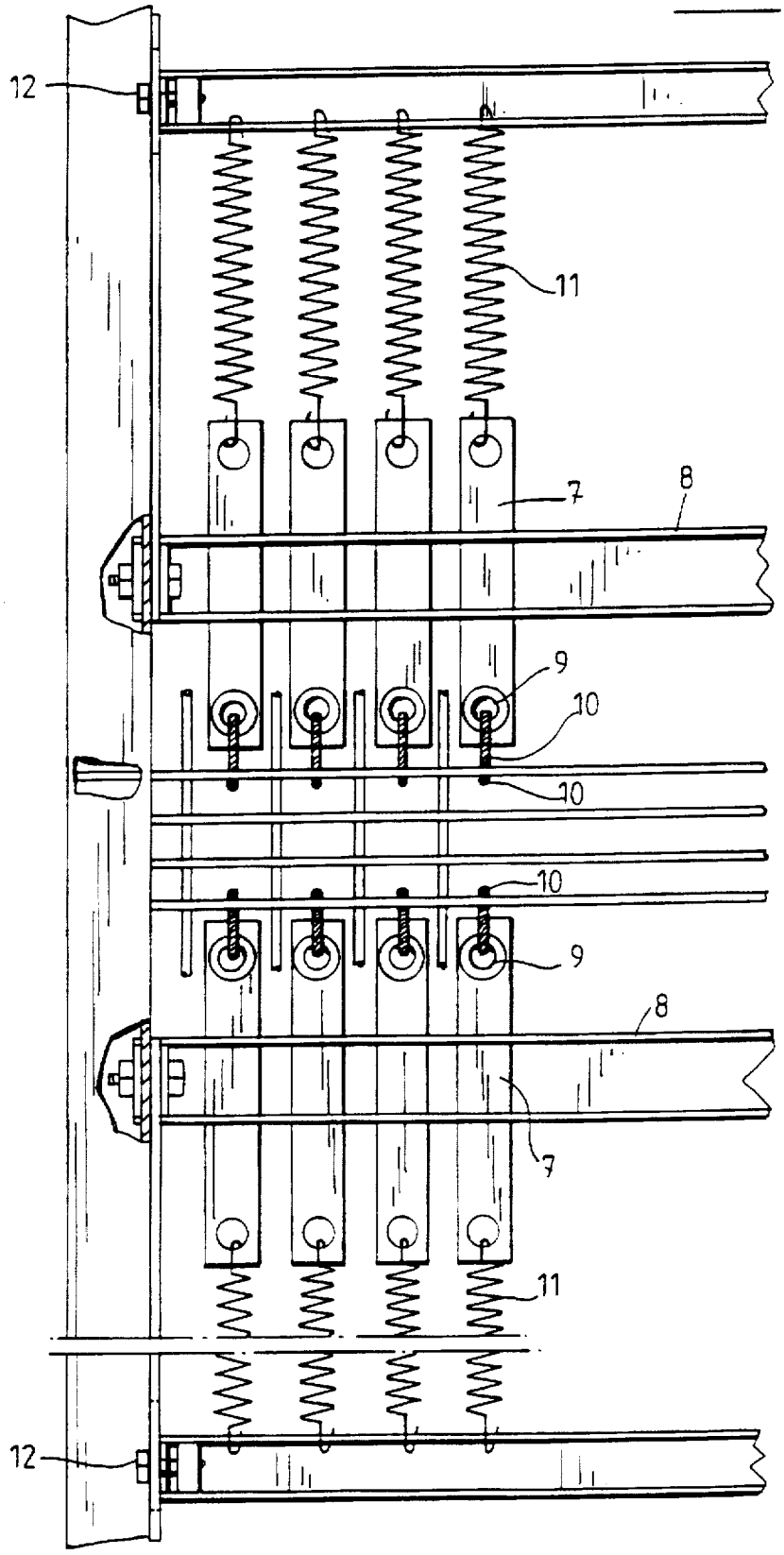
FIG. 4: a front view of the thread-tensioning and pull-back device shown in FIG. 3.

The thread-tensioning and pull-back device is placed at the front in the doors of the rack 3 and between two guide grates 13. As shown in FIGS. 3 and 4, this thread-tensioning device consists of a metal strip 7 which is disposed vertically and in such a way that it can slide in a U-shaped holder 8. A feed-through eye 9 is fitted in a bore in the top of this strip 7. This strip 7 consequently cannot fall out of the holder 8.

In a first embodiment, shown in FIGS. 3 and 4, the strips 7 are kept sufficiently short and loaded with a tension spring 11, the initial tension of which can be set. Moreover, the thread layer per row of bobbins of the rack 3 can be split into a bottom and a top layer. A first row of downward working strips 7 acts upon the bottom layer, and a second row of upward working strips 7 acts upon the top layer. This means that the warp thread layer can be divided into two layers, with the result that the threads rub against each other less, and the chance of them becoming entangled with each other is consequently lower. The pull-back force can be set by regulating the initial tension of the tension spring 11, which can be regulated per row in groups by setting with the aid of adjusting nuts 12 (see FIG. 4). The tension springs 11 can operate in two planes adjacent to each other, so that they can be accommodated in the vertical division of the bobbins 1.

This thread-tensioning device works for all warp threads 10 at virtually the same distance from the weaving zone 2, and the pull-back force is thus no longer so dependent on the depth of the bobbin 1 in the rack 3. The pile height of face-to-face fabrics will be more uniform. This device also continues working while a bobbin 1 is being changed on the rack 3. Changing a bobbin 1 causes less disruption to the weaving process.

In a second embodiment, the thread-tensioning and pull-back device is placed at the front in the doors of the weaving rack 3 and between two warp thread combs 16 and 20, which serve as guide grates. As shown in FIGS. 5–8 this thread-tensioning device consists essentially of a leaf spring 15.

The leaf spring 15 is clamped at one side. The other, free end is bent with a feed-through eye 9. The support 17 for the leaf spring 15 is fixed to a shaft 18. Said shaft is disposed rotatably in the frame 21 and can be fixed in various positions, in order to be able to impose a certain adjustable initial tension. These leaf springs 15 can be placed adjacent to each other, and permit a high density of the warp threads 10. These leaf springs 15 can all work in the same direction, for example downwards, so that the setting will be the same for all leaf springs 15 when the angular displacement of the shaft 18 is the same. A first row of downward working leaf springs 15 acts upon the bottom layer, and a second row of upward working leaf springs 15 acts upon the top layer. In this way the warp thread layer is divided into two layers, with the result that the threads rub against each other less and the chance of entanglement with each other is reduced.

Figure 5:
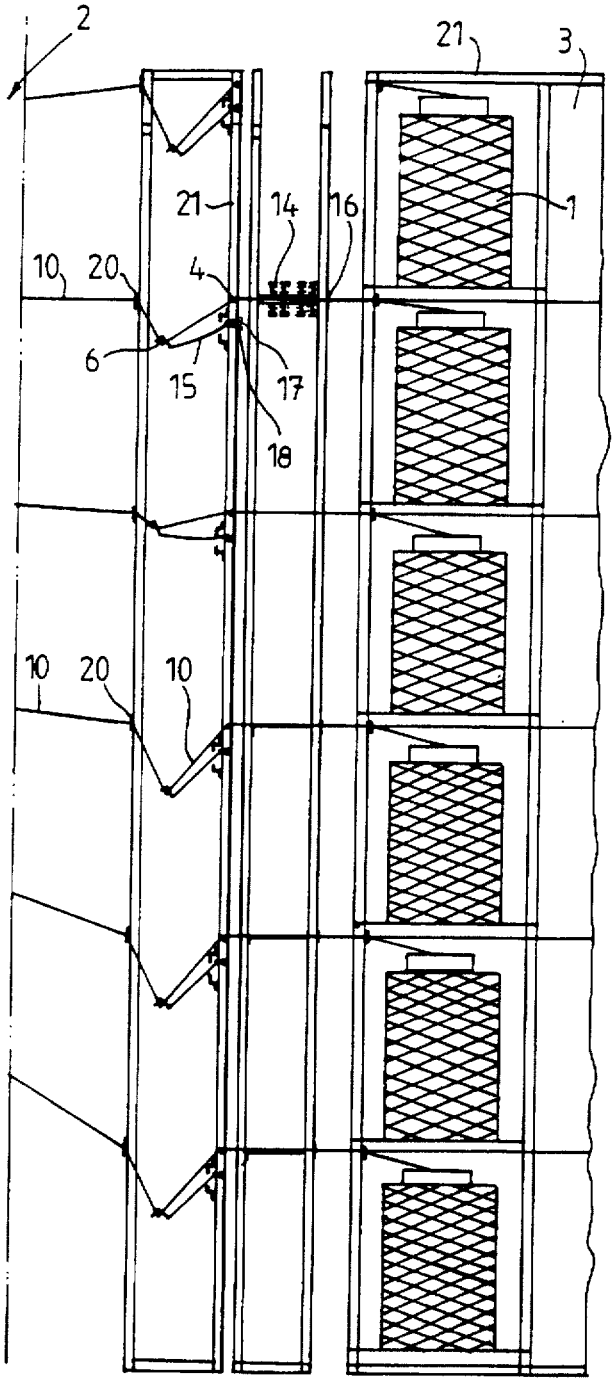
FIG. 5: a side view of a second embodiment of bobbin rack with tensioning device according to the invention.
Figure 6:
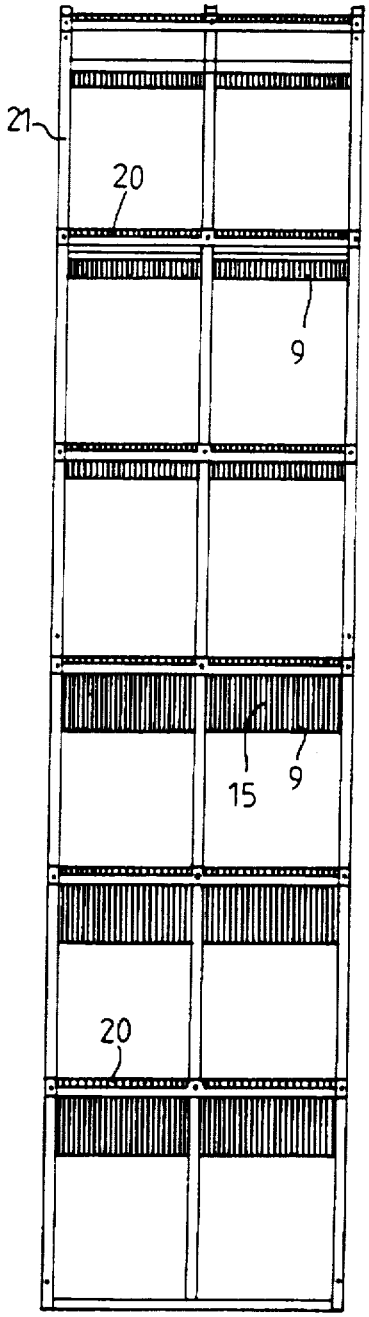
FIG. 6: a front view of the thread-tensioning and pull-back device shown in FIG. 5.
Figure 8:
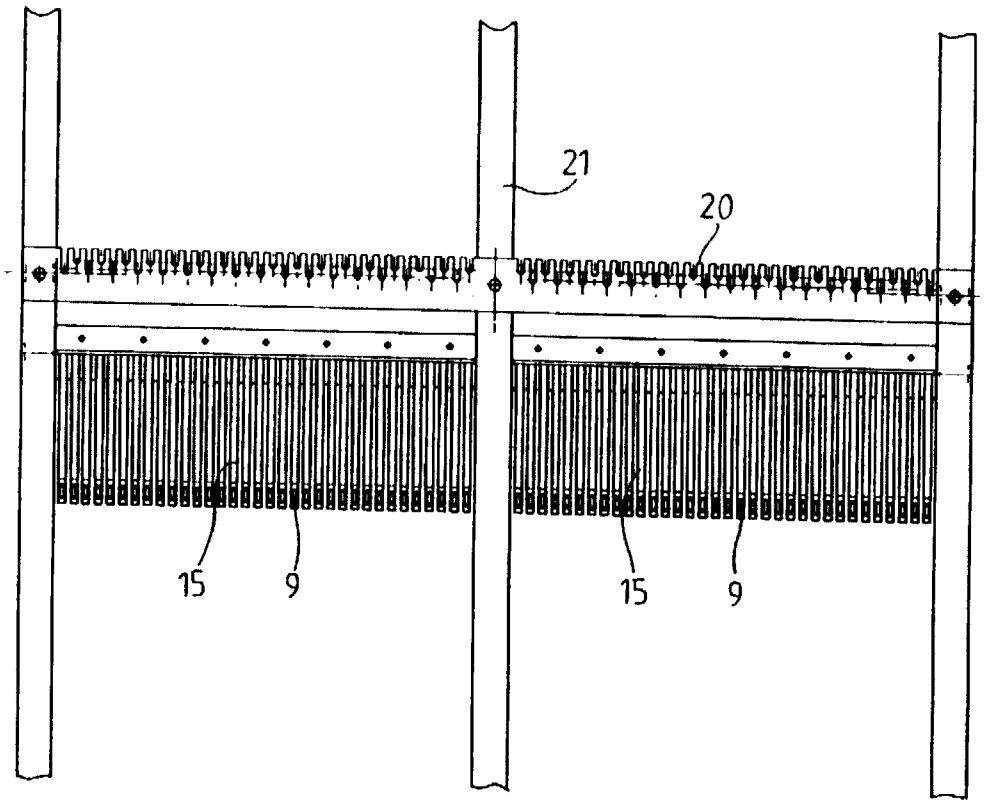
FIG. 8 is an enlarged view of a portion of FIG. 6.
Figure 7:
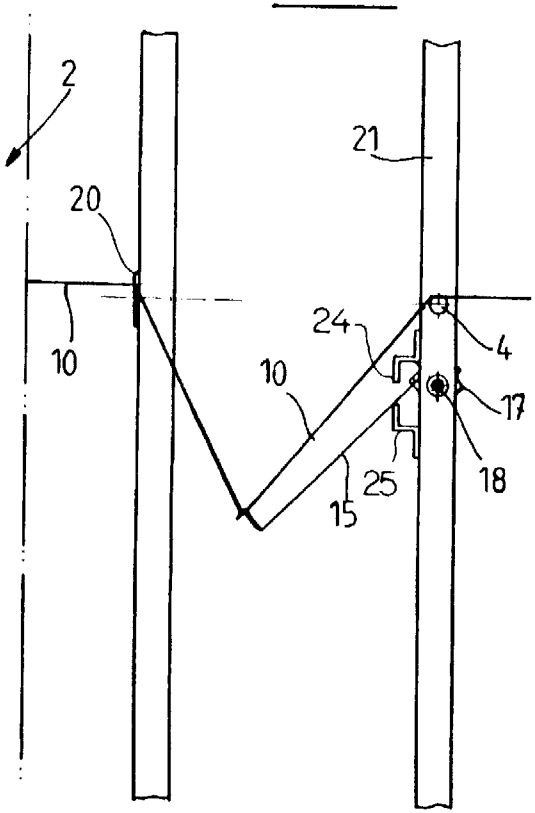
FIG. 7: an enlarged view of the thread-tensioning and pull-back device according to the invention.

The warp thread tension at which weaving is to take place is set with thread brake 14 (as shown in FIG. 5). The warp thread brake may be of known design. Alternatively, each wrap thread bobbin may be braked 14 by a continuous band brake per row or part of a row (as shown in FIG. 2).

The warp thread is pulled back out of the weaving zone by the leaf spring 15. The pull-back force is set by regulating the initial tension of the spring 11, which can be regulated per row in groups by setting with the aid of adjusting nuts 12 (see FIG. 4). The springs can work in two planes adjacent to each other, so that they can be accommodated in the vertical division of the bobbins 1.

The warp threads are separated neatly from each other by the warp thread combs 16 and 20. The above is installed integrally in a module which is disposed in a fixed manner on the ground and is independent of the weaving rack behind it. The warp thread tension will thus be determined much less by the position of the bobbin in the weaving rack. A bobbin 1 in the rack 3 can thus be replaced without a disruption of the warp thread tension occurring.

If the warp thread for some reason or other is prevented from unreeling from the bobbin, the warp thread will tighten, and the feed-through eye 9 of the leaf spring 15 will move into line with the thread. This extreme position of the leaf spring 15 can be detected by a sensor or electrode 24, with the result that a signal to stop the weaving machine can be given. If the warp thread 10 breaks in the region between the weaving zone 2 and the warp thread brake 14, then the leaf spring 15 will deflect into its most relaxed position. This position can also be detected by a sensor or an electrode 25 and generate a stop signal for the weaving machine. This device can possibly replace the warp stop motion.

This warp thread device works for all warp threads 10 at virtually the same distance from the weaving zone 2, so that the pull-back force is no longer so dependent on the depth of the bobbin 1 in the rack 3. The pile height of face-to-face fabrics will be more uniform. This device also continues to work while a bobbin 1 on the rack 3 is being changed. The changing of a bobbin 1 produces less disruption to the weaving process.

We claim:

1. A thread-tensioning and pull-back device for use with a weaving machine for controlling tension of a series of warp threads pulled off from removable and replaceable bobbins arranged in rows in a weaving rack of a weaving machine, said device being adapted to be disposed in front of said weaving rack of said weaving machine and comprising a series of thread guide plates each having a feed-through eye for each thread whereby each guide plate tensions the thread through each guide plates own weight, and wherein each guide plate includes spring means for tensioning the thread.

2. The device according to claim 1, further comprising bearing spindles for each warp thread and a braking device consisting of a continuous brake band and a tensioning device, wherein each of said spindles is equipped with a plastic rotating sleeve, whereby each of several of said warp thread bobbins in a row or part of a row are braked by said brake band stretched over said rotating sleeves, said brake band being adapted to be clamped at one end by said tensioning device so as to be able to brake the bobbins as desired.

3. A thread-tensioning and pull-back device for use with a weaving machine for controlling tension of a series of warp threads pulled off from removable and replaceable bobbins arranged in rows in a weaving rack of a weaving machine, said device being adapted to be disposed in front of said weaving rack of said weaving machine and comprising a series of thread guide plates each having a feed-through eye for each thread whereby each guide plate tensions the thread through each guide plates own weight, and wherein each guide plate is disposed slidably in a holder.

4. The device according to claim 3, further comprising bearing spindles for each warp thread and a braking device consisting of a continuous brake band and a tensioning device, wherein each of said spindles is equipped with a plastic rotating sleeve, whereby each of several of said warp thread bobbins in a row or part of a row are braked by said brake band stretched over said rotating sleeves, said brake band being adapted to be clamped at one end by said tensioning device so as to be able to brake the bobbins as desired.

5. A thread-tensioning and pull-back device for use with a weaving machine for controlling tension of a series of warp threads pulled off from removable and replaceable bobbins arranged in rows in a weaving rack of a weaving machine, said device being adapted to be disposed in front of said weaving rack of said weaving machine and comprising a frame, a series of thread guide plates supported in said frame and a feed-through eye for each thread whereby at least one of the plates consists of a leaf spring which is clamped at one side to said frame and tensions the thread by bending stress.

6. The device according to claim 5, wherein the plate consisting of a leaf spring is bent over at one free end, said free end being provided with said feed-through eye.

7. The device according to claim 6, wherein each leaf spring is connected to an adjustable support attached to a shaft, rotatably provided in said frame of the device for adjusting initial tension of said leaf springs.

8. The device according to claim 6, further comprising warp thread brakes for keeping the warp threads under tension, and a warp thread guide spindle located between the warp thread brakes and the leaf springs.

9. Device according to claim 8, further comprising thread guide combs, wherein said thread guide combs, leaf springs and thread brakes are adapted to be assembled in an independent module for installation at the front of and separately from the weaving rack.

10. The device according to claim 6, including a sensor or electrode adapted to sense or detect an extreme deviation in the bend of the leaf spring due to excessive tension of the warp thread when there is a fault in unreeling from a bobbin, in which case the feed-through eye of the leaf springs comes in line with the thread, whereas said sensor or electrode converts this into a signal which brings the weaving machine to a standstill.

11. The device according to claim 6, including a sensor or electrode adapted to sense or detect a deflection of the leaf spring to a most relaxed position of the leaf spring when there is a thread breakage, whereby said sensor or electrode converts the deflection into a signal which brings the weaving machine to a standstill.

* * * * *